United States Patent [19]

Paterson et al.

[11] 4,359,667

[45] Nov. 16, 1982

[54] CONVECTIVELY COOLED ELECTRICAL GRID STRUCTURE

[75] Inventors: James A. Paterson; Gary W. Koehler, both of Oakland, Calif.

[73] Assignee: The United States of America as represented by the Department of Energy, Washington, D.C.

[21] Appl. No.: 205,077

[22] Filed: Nov. 10, 1980

[51] Int. Cl.[3] ..... H01J 1/16; H01J 7/26

[52] U.S. Cl. ..... 313/348; 313/35

[58] Field of Search ..... 313/348, 35, 30, 22, 313/12

[56] References Cited

U.S. PATENT DOCUMENTS

| | | | |
|---|---|---|---|
| 2,801,357 | 7/1957 | Lamm | 313/348 |
| 3,152,276 | 10/1964 | Dorgelo | 313/30 |
| 3,247,420 | 4/1966 | Mayer | 315/42 |
| 3,337,933 | 8/1967 | Seiffarth | 313/348 |
| 3,423,684 | 1/1969 | Purser | 328/233 |
| 3,530,497 | 9/1970 | Hirsch et al. | 73/863.25 |
| 3,594,604 | 7/1971 | Tritchler et al. | 313/35 |
| 3,760,225 | 9/1973 | Ehlers et al. | 313/63 |
| 3,846,668 | 11/1974 | Ehlers et al. | 376/128 |
| 3,850,231 | 11/1974 | Creek | 165/158 |
| 4,140,943 | 2/1979 | Ehlers | 313/161 |

OTHER PUBLICATIONS

"The Mechanical Design . . . " by J. A. Paterson et al., Lawrence Berkeley Lab Report LBL-10095, Nov. 12, 1979.

"Convective Helium Cooling . . . " by M. A. Hoffman, Nuclear Technology, vol. 44, Aug. 1979, pp. 346-356.

"Mechanical Design . . . " by S. R. Vosen et al.,UCRL-79730, Oct. 6, 1977.

"The Design of a 10 kV . . . " by Thomas J. Duffy et al., UCRL-81547, Oct. 17, 1978.

*Primary Examiner*—Harold A. Dixon

[57] ABSTRACT

Undesirable distortions of electrical grid conductors (12) from thermal cycling are minimized and related problems such as unwanted thermionic emission and structural failure from overheating are avoided by providing for a flow of fluid coolant within each conductor (12). The conductors (12) are secured at each end to separate flexible support elements (16) which accommodate to individual longitudinal expansion and contraction of each conductor (12) while resisting lateral displacements, the coolant flow preferably being directed into and out of each conductor through passages (48) in the flexible support elements (16). The grid (11) may have a modular or divided construction which facilitates manufacture and repairs.

16 Claims, 4 Drawing Figures

CONVECTIVELY COOLED ELECTRICAL GRID STRUCTURE

BACKGROUND OF THE INVENTION

The U.S. government has rights in this invention pursuant to contract number W-7405-eng-48 between the U.S. Department of Energy and the University of California.

This invention relates generally to grids of the type used in electrical apparatus to control the electrical potential or electrical field configuration at a predetermined region while providing openings for the passage of ions, electrons or the like through the region. More particularly, this invention relates to electrical grids having cooling means for removing heat from the grid during operation.

A variety of electrical systems include one or more grids formed of spaced apart conductors to which a controlled voltage is applied. Such grids enable control of the electrical potential and electrical field configuration across a predetermined region while providing openings through which charged particles or the like may pass through the controlled region.

Grid heating tends to occur in many systems as a result of the impact of high energy charged particles on the grid conductors or from heat received from adjacent high temperature components or from other causes. If not counteracted, overheating may occur and cause a variety of adverse effects. For example, thermal expansion may distort the grid conductors and thereby disrupt critical alignments and spacings with respect to other grids or other components of the system. Unwanted thermionic emission of electrons may occur if the grid material is heated to incandescence and the released electrons may neutralize or otherwise disrupt charged particle beams that are being transmitted through the grid. In extreme cases, structural failure of the grid conductors may occur from overheating.

Avoidance of the above described problems is in part a matter of providing for cooling of the grid conductors. Known grid cooling techniques tend to be inherently inefficient at least in many contexts. A common practice has been simply to rely on the radiation of heat from the grid conductors and on heat conduction along the grid conductors into the support members to which the conductors are attached. Where this is inadequate, it is also a known practice to circulate fluid coolant through the supports or frame to which the grid conductors attach.

Unfortunately, heat elimination by radiation from the grid conductors may be minimal or even negative if surrounding elements are at high temperatures. Heat removal by conduction is also inhibited in most cases as grid elements tend to be very lengthy in relation to their transverse dimensions. That configuration is not conducive to rapid heat tranfer by conduction. While heat removal is increased where a fluid coolant is passed through the frame, prior fluid cooled grid constructions remain basically dependent on the inefficient process of heat conduction along the elongated grid elements.

Consequently known grid constructions do not provide for heat dissipation at a rate which would be desirable in many systems in which grids are employed. Pulse length or duty cycle may have to be limited simply to avoid overheating of grid electrodes.

Under the best of circumstances it is often not possible to maintain an electrical grid at constant temperature and thereby avoid dimensional changes from thermal cycling. In a pulsed electrical apparatus, for example, heat input to a grid occurs primarily during the pulse periods and usually drops substantially during the intervals between pulses. Consequently, in addition to providing for cooling, avoidance of certain of the problems discussed above is also in part a matter of accommodating to expansion and contraction in such a way as to minimize misalignments of grid conductors with other elements in the system which can arise from thermally induced distortion. In many instances some axial extension and contraction of grid conductors is tolerable while lateral displacements of any sizable degree may not be. Accordingly, in some prior grid constructions one or both ends of the grid conductors are slidable relative to the supports and thus are free to move to a limited extent in the axial direction relative to the supporting structure while being rigidly restrained against sideward movement. While this minimizes the more undesirable forms of thermally induced distortion, it also tends to inhibit heat transfer by conduction from the end of the conductor to the support. Thus the problems of limiting heating of an electrical grid and of accommodating to the often inevitable thermal distortions and displacements are closely related matters but efforts to minimize one problem by known techniques may aggravate the other.

As a practical matter the limited capabilities of prior grid structures with respect to resolving problems caused by heat seemingly place undesirable restrictions on the operation of certain systems in which such grids may be employed. Considering a specific example, neutral beam fuel injection systems in certain forms of reactor for initiating, containing and controlling thermonuclear fusion reactions require the extraction of a high energy beam of ions from an electrical plasma generator, an example of such a system being described in U.S. Pat. No. 4,140,943 of Kenneth W. Ehlers, issued Feb. 20, 1979 and entitled "Plasma Generating device with Hairpin Shaped Cathode Filaments". In such systems, the ion beam is extracted from the plasma by an electrical field established by a series of spaced apart grids. Current fuel injection systems of this type are designed to operate with longer ion pulses than has heretofore been the case and conceivably on a D.C. or continuous basis. As a result, grid heating problems of the kind discussed above are greatly aggravated. Known grid constructions do not provide for heat removal at a rate adequate for such usages.

SUMMARY OF THE INVENTION

Accordingly, it is an object of this invention to provide for more efficient cooling of electrical grid structures.

It is another object of this invention to provide for direct convective cooling of the spaced apart conductors of an electrical grid.

It is still another object of this invention to minimize the undesirable effects of thermally induced distortions in an electrical grid without inhibiting heat dissipation from the grid conductors.

Still a further object of this invention is to provide for the transmission of charged particle beams of very high average energy density through electrical grid structures.

It is still another object of the invention to enable more precise control of electrical potential and electrical field configuration, in a region through which charged particle beams are transmitted, by reducing thermal distortions of grid elements.

Additional objects, advantages and novel features of the invention will be set forth in part in the discussion which follows and in part will become apparent to those skilled in the art upon examination of the following or may be learned by practice of the invention. The objects and advantages of the invention may be realized and obtained by means of the instrumentalities and combinations particularly pointed out in the appended claims.

To achieve the foregoing and other objects and in accordance with an embodiment of the invention as described herein, a fluid cooled electrical grid structure has a plurality of electrical conductors spaced apart to define a plurality of openings through the grid structure and has conductor support means for supporting the conductors while enabling axial extension and contraction of the conductors in response to temperature changes. The conductors are provided with internal flow passages and convective cooling means are provided for directing a flow of fluid coolant through the internal flow passages of the conductors.

In another aspect of the invention, the grid structure includes support means for the conductors which enables individual extension and contraction of each of the conductors relative to the others thereof. In still another aspect, the support means enables independent longitudinal expansion and contraction of each of the conductors while being relatively resistant to movement of the conductors towards each other.

In still another aspect of the invention, the support means includes a plurality of flexible conductor supports to which the conductors are secured, each of the supports being flexible independently of the others and wherein each of the flexible conductor supports has a coolant passage communicated with the internal flow passage of the associated one of the conductors, and wherein the convective cooling means circulates fluid coolant within the conductors through the coolant passages of the supports.

By providing for an internal flow of fluid coolant within the spaced apart conductors of an electrical grid, the invention enables rapid removal of large quantities of heat. The grid may be operated in a very high temperature environment and/or in the presence of charged particle beams of very high energy density with minimal adverse effects from heating. Thermally caused distortions of the grid members are reduced. To the extent that such distortions cannot be eliminated, the invention in a preferred embodiment enables axial extension and contraction of the grid conductors while resisting undesirable lateral distortions and this is accomplished without interfering with the highly efficient convective cooling. Consequently, in the preferred embodiment, grid conductor locations may be maintained within predetermined tolerances under severe operating conditions.

BRIEF DESCRIPTION OF THE DRAWINGS

The accompanying drawings which are incorporated in and form a part of the specification, illustrate preferred embodiments of the invention and, together with the description, serve to explain the principles of the invention. In the drawings.

DETAILED DESCRIPTION OF THE INVENTION

Reference will now be made in detail to the present preferred embodiment of the invention, which is illustrated in the accompanying drawings.

Figure 1:
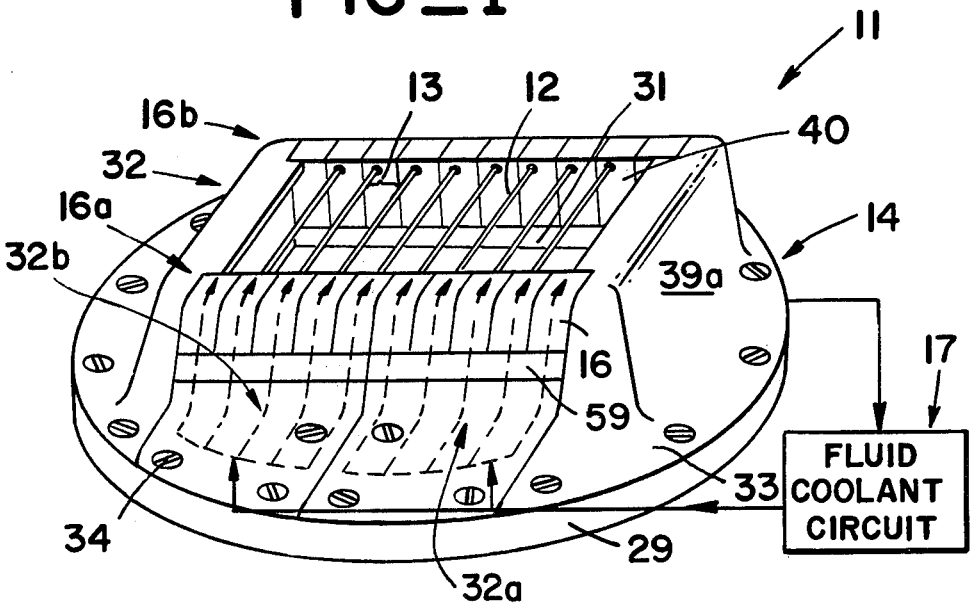
FIG. 1 is a perspective view of an electrical grid structure in accordance with an embodiment of the invention with the fluid coolant circuit being depicted diagrammatically.

Referring initially to FIG. 1, an electrical grid 11 in accordance with an embodiment of the invention includes a plurality of electrical conductors or rails 12 which are spaced apart to define a series of openings 13 through the grid to allow passage of ions, electrons or the like through the grid region. Most typically, as in this example, the portion of the grid 11 which includes conductors 12 and openings 13 is planar and thus the conductors 12 are linear and disposed in parallel relationship with each other although other grid configurations and thus other conductor configurations may be required in some instances. In the present example the region of the conductors 12 and openings 13 is rectangular and thus the conductors 12 are each of equal length although the invention is adaptable to other grid geometries by utilizing spaced apart conductors having differing lengths.

The grid 11 further includes support means 14 for the conductors 12 for securing the conductors in place in the grid structure and which provide for mounting of the grid in the apparatus in which it is to be used. As will hereinafter be described in more detail, the support means 14 also enables individual movement of each of the conductors 13 relative to the others thereof. For this purpose, the support means 14 includes a plurality of flexible support elements 16 of which an individual one is situated at each end of each of the conductors 13.

Also in accordance with the invention, convective cooling means 17 are provided for directing a flow of fluid coolant through conductors 13 as will also hereinafter be described in more detail.

Figure 2:
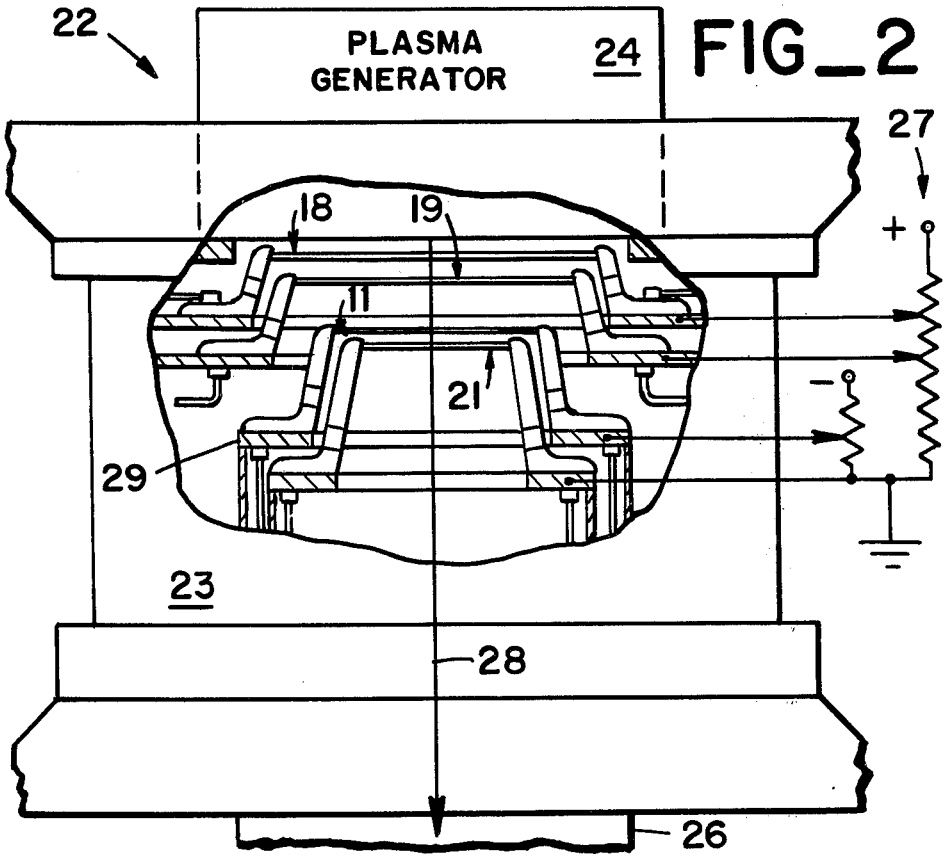
FIG. 2 is a broken out side view of a charged particle accelerator for producing a high energy ion beam and which includes a series of charged electrical grids in accordance with embodiments of the invention.

Grids 11 embodying the invention may be employed in a variety of different types of electrical apparatus and the configuration of the support means 14 may be varied to accommodate to the specific context in which the particular grid 11 is used. Referring now to FIG. 2 the grid 11 of the present example was designed to function as one of a series of essentially similar grids including additional grids 18, 19 and 21 which are situated within an ion beam accelerator 22 of the general type described in the hereinbefore identified U.S. Pat. No. 4,140,943.

The accelerator 22 is a component of a neutral beam fuel injector for systems of the type which initiate and magnetically contain controlled thermonuclear fusion reactions for power production or other purposes. In this context the grids 11, 18, 19 and 21 are situated within an evacuated cylindrical insulator 23 between an electrical plasma generator 24 and an ion beam output tabulation 26. Grid 18, termed the source grid, is adjacent plasma generator 24 while grids 19, 11 and 21 respectively constituting a gradient grid, suppressor grid and exit grid are progressively more distant from the plasma generator in the direction of the output tabulation 26. The final or exit grid 21 is electrically grounded while a pulsed direct current high voltage source 27 applies a high positive voltage to a source grid 18, a somewhat smaller positive voltage to gradient grid 19 and, to enhance beam focussing, a relatively small negative voltage to the suppressor grid 11.

In this example, the voltages applied to grid 18, 19 and 11 are respectively +120 kV, +100 kV, and −2 kV. Plasma generator 24, into which hydrogen or other gas is admitted, is at the same high positive potential as source grid 18. Thus the series of grids, 18, 19, 11 and 21 electrostatically extract and accelerate positive ions of hydrogen or other elements from the plasma generator 24 and cause a high energy beam 28 of such ions to be directed into the output tabulation 26 for delivery to the fusion reaction containment apparatus through an ion neutralizer.

To optimize the ion extraction and acceleration process and to minimize ion beam disruption and heat generation from ion impacts on components of the system, the corresponding conductors 12 of the successive grids 18, 19, 11 and 21 should be maintained in alignment with each other and with predetermined spacings from each other. As plasma generator 24 produces a substantial amount of heat and as ion impacts on components of the grids cannot be wholly avoided, grid heating occurs in operation. This in turn tends to cause thermally induced distortions and displacements of the conductors 13 that interfere with maintenance of the preferred spacings and alignments. Referring again to FIG. 1, the grid 11 construction including convective cooling means 17 minimizes such effects and optimizes efficiency of the beam production process.

With reference to FIG. 1, in order to accommodate to the above described specific use context, the support means 14 of the grid 11 of this example has a circular frame member 29 with a central opening 31 which is of rectangular configuration to conform with that of the grid conductors 12 and grid openings 13 although the opening 31 is preferrably larger than the area occupied by the grid conductors.

Conductor support elements 16 are parts of a conductor mounting assembly 32 having a flange portion 33 that conforms in configuration with frame member 29 and which is secured to the frame member by suitable means such as screws 34. Support elements 16 in this example extend outward from the flange portion 33 of the mounting assembly 32 and are arranged in first and second columns **16*a* and 16*b* respectively which extend along opposite ends of the conductors 12. The support elements 16 of each column 16*a*, 16*b* are in side by side parallel relationship with each other and are preferrably angled relative to frame member 29 to cause the two columns to be somewhat convergent in the outward direction from the frame member. A separate one of the support elements 16 is adjacent each end of each of the conductors 12. As may best be seen by reference to FIG. 3, each end of each conductor 12 is secured to the adjacent one of the support elements 16, close to the outer extremities of the support elements, the ends of the conductors being brazed to the support elements in this example as this facilitates replacement of a conductor in the event of burnout. The thin slots 36 between adjacent ones of the support elements 16** enable independent flexing of each such support element relative to the adjacent ones.

Figure 4:
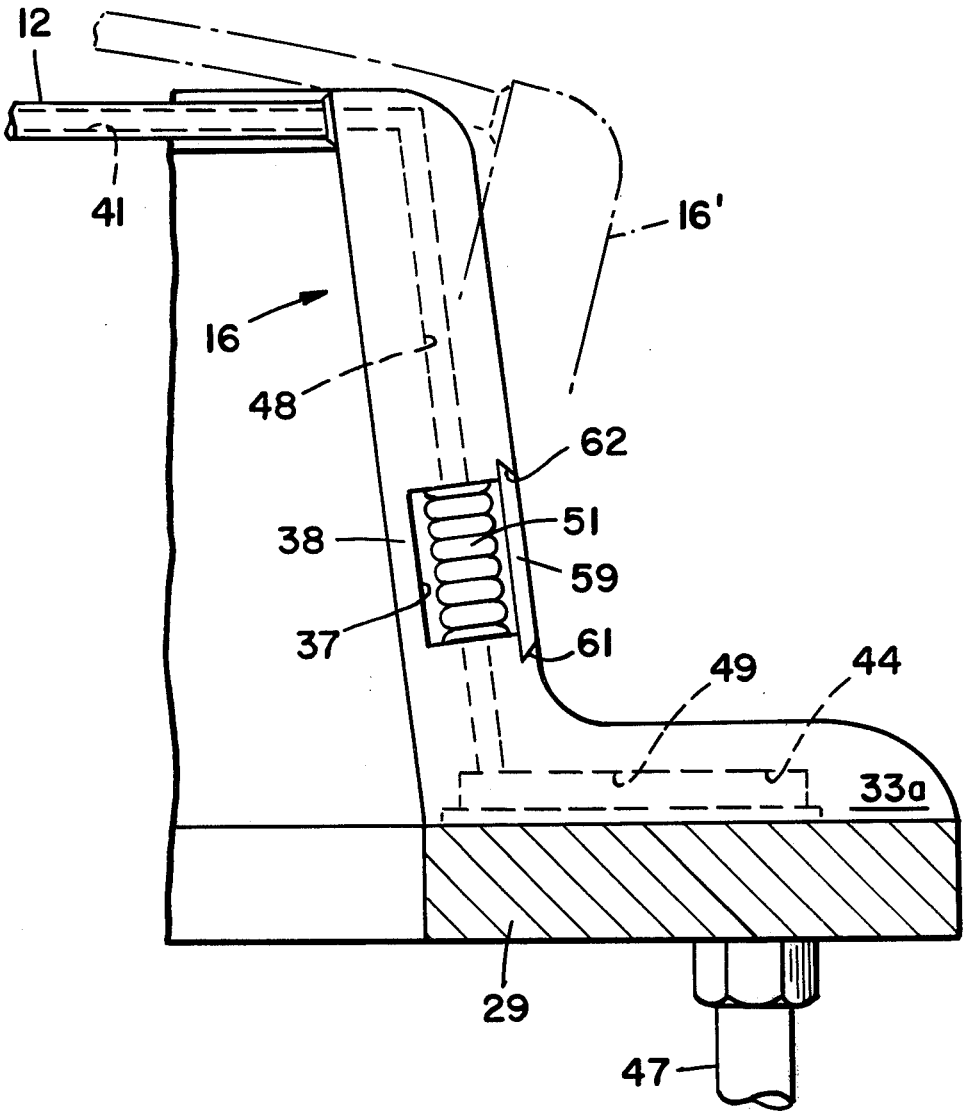
FIG. 4 is a section view of a portion of the grid structure of FIG. 3 taken along line IV—IV thereof.

Referring now to FIG. 4, the support elements 16 in this example are formed of a resilient electrically conductive metal such as stainless steel for example and to provide the degree and kind of resilient flexibility which are desired, a notch or recess 37 is cut out of each such support element to provide an inner wall portion 38 of reduced thickness relative to the other portions of the support element, the recess being situated close to flange portion 33 of the conductor mounting assembly 32 and away from the associated grid conductor 12. Thus as indicated by dashed line 16' in FIG. 4, the support element may flex outwardly and inwardly, primarily at wall portion 38, to accommodate to thermally induced axial expansion and contraction of the associated grid conductor 12 while being relatively resistant to lateral displacements of the grid conductor towards the adjacent grid conductor. The degree of flexing depicted by dashed line 16' in FIG. 4 is greatly exaggerated, for clarity of illustration, relative to what typically occurs in the course of operation, deflections of small fractions of a millimeter being more typical.

Referring again to FIG. 1, the conductor mounting assembly 32 further includes a pair of conductive endwalls **39*a* and 39*b* which extend outward from flange portion 33 of the assembly adjacent opposite ends of the two columns 16*a* and 16*b* of support elements 16, the endwalls being parallel to the grid conductors 12. Endwalls 39*a* and 39*b* each have an edge 40 adjacent an end one of the conductors 12**, the edge being angled to extend towards and partially cover the adjacent conductor.

To facilitate manufacture, the conductor mounting assembly 32 is formed of four separate components having juxtaposed parallel end surfaces. The four components include first and second conductor mounting members **32*a* and 32*b* respectively and the endwall members 39*a* and 39*b*. Preferably, one half of the conductors 12 and support elements 16 are on one member 32*a* and the other half of the conductors and support elements are on the other member 32*b***.

The construction of the grid 11 as described to this point provides for positive securing of the ends of the grid conductors 12 to support elements 16 while accommodating to axial growth and shrinkage of the conductors from thermal cycling. In order to reduce such dimensional changes and to enable operation of the grid 11 under more severe temperature conditions than would otherwise be practical, the convective cooling means 17 directs a flow of fluid coolant which may typically be water, into each support element 16 at one end of the grid conductors 12. The flow then passes through each of the grid conductors 12 and is discharged through the support elements 16 at the opposite ends of the conductors.

Figure 3:
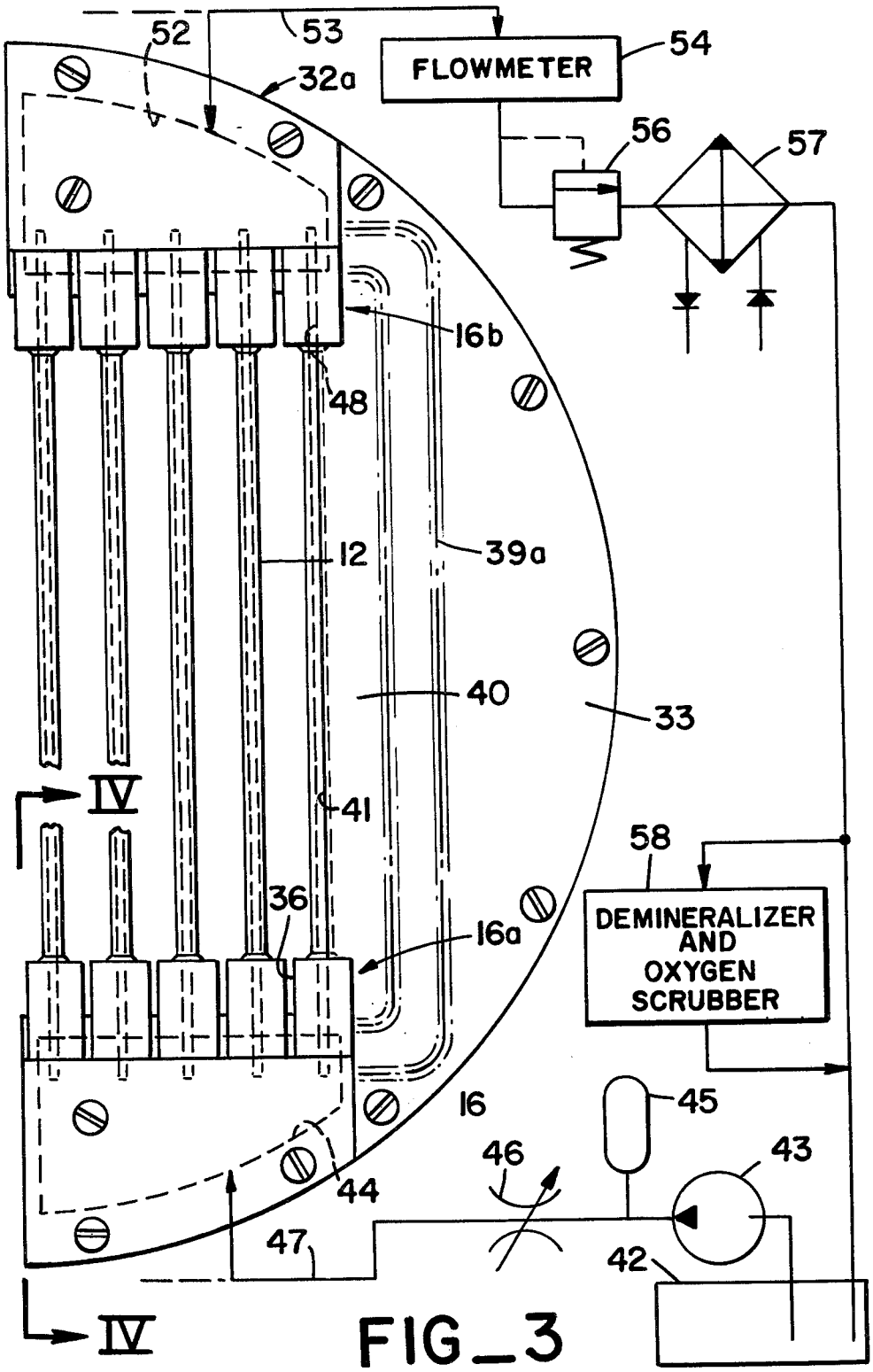
FIG. 3 is a plan view of a portion of the electrical grid structure of FIG. 1 and which further depicts, in schematic form, details of the fluid coolant circuit for the grid structure.

Considering the convective cooling means 17 in more detail, with reference to FIG. 3, the grid conductors 12 are hollow tubes and thus each such conductor has an internal flow passage 41 extending axially between the ends of the conductor. Coolant from a reservoir 42 is delivered by a pump 43 to inlet manifold chambers 44 in the flange portion 33 of each conductor mounting member **32*a* and 32*b* through an adjustable flow control valve 46 and flow line 47. To smooth pressure pulsations, an accumulator 45 is communicated with the outlet of pump 43**.

Referring to FIG. 4 in conjunction with FIG. 3, each of the support elements 16 of column 16*a* has an internal coolant passage 48 communicated with the one of the inlet manifold chambers 44 which is in the same conductor mounting member 32*a* or 32*b*. The coolant passage 48 of each support element 16 communicates with the internal flow passage 41 of the grid conductor 12 which the element 16 supports.

As seen in FIG. 4 in particular, the portion of the coolant passage 48 of each support element 16 which extends across the recess 37 of the support element is formed by an extendable and contractable fluid transmitting element 51 which accommodates to the previously described flexing of the support element about the reduced thickness portion 38. In the present example the extendable and contractable fluid transmitting elements 51 are hollow tubular bellows having ends brazed to the opposite walls of the recesses 37.

Referring again to FIG. 3, the flexible support elements 16 of the column 16*b* at the opposite ends of the grid conductors 12 are of the same construction described above and transmit the fluid coolant flow to an outlet manifold chambers 52 in the opposite flange portions 33 of the conductor mounting members 32*a* and 32*b*.

In the present example of the invention the fluid coolant is returned to reservoir 42 for recirculation through the grid. For this purpose a return flow line 53 communicates outlet manifold chambers 52 with reservoir 42 through a flow meter 54, a back pressure valve 56 and heat exchanger 57 all of which may be of known constructions. Back pressure valve 56 is of the form which constricts or in extreme cases blocks the return flow path 53 to the extent necessary to maintain a predetermined minimum pressure within the internal flow passages 41 of the grid conductors 12. This assures that coolant is always present in the grid conductors 12 and inhibits the formation of steam pockets or films within the grid conductors that can otherwise reduce heat transfer into the fluid coolant. Heat exchanger 57 recools the fluid coolant for recirculation through the grid 11. Where the coolant is water as in this example, it is advantageous if at least a portion of the return flow from heat exchanger 57 to reservoir 42 is diverted through a demineralizer and oxygen scrubber 58 which may be of known construction. This reduces corrosion and possible clogging of flow paths in the fluid coolant circuit. For similar reasons it is preferable that the reservoir 42 be of the type which is charged with an inert gas such as nitrogen rather than with air.

As the grid 11 may be operated at very high voltages at least in some cases, and as may be seen by reference to each of the figures, it is advantageous in such contexts if the various external edges, corners and the like of components of the grid are formed with rounded contours to the extent possible as this acts to inhibit arcing and corona discharges. Referring to FIGS. 1 and 4 in particular, avoidance of sharp external edges in the region of the recesses 37 and bellows 51 of the support elements 16 is provided for by closure means which in this example are flat rectangular cover plates 59 that also serve to protect the bellows 51 from possible mechanical damage or possible damage from stray electrical plasma. Cover plates 59 are engaged in the support elements 16 in a manner which does not block the desired flexing of the support elements. In particular and as may be seen in FIG. 4, opposite edges of the cover plates are beveled and slidingly engage in matching grooves 61 and 62 which extend along the opposite facing surfaces of support element recesses 37. Although not apparent in FIG. 4 because of the scale of the drawing, the depth and spacing of the grooves 61 and 62 is slightly greater than is required simply to receive the cover plate 59 so that the support element 16 may flex in the manner indicated in an exaggerated fashion by dash line 16' without constraint by the cover plate. As may be seen in FIG. 1, an individual one of the cover plates 59 in this example extends along one half of the support elements 16 of each column 16*a* and 16*b*. The cover plates 59 are implaced prior to fastening of the conductor mounting members 32*a* and 32*b* to frame member 29 and after assembly of the grid 11, the cover plates are held in place by abutment against each other and against end walls 39*a* and 39*b*.

Certain characterisics of the grid 11 as herein described are adaptations to the particular specific usage of the described grid as depicted in FIG. 2 and the construction may be varied to adapt to usages in other contexts. Thus in the above described embodiment, the length of the support elements 16 and the angling of such support elements and also the outer diameter of the grid 11 as a whole and the length of the grid conductors 12 have been selected to adapt to the preferred positions and spacing of the several grids 18, 19, 11 and 21 within the ion beam source 22. In this particular context, the preferred grid positions are such that the grids 18, 19, 11 and 21 are of progressively smaller extent with progressively shorter grid conductors 12 but also having progressively longer support elements 16 so that the several grids may be disposed in a nested assembly of grids. Other variations in configuration may be made to accommodate to other specific usages.

In operation, with reference to all figures of the drawings, heat produced within the grid 11 or received from external sources is efficiently removed from the grid by the circulating fluid coolant which provides for direct convective heat transfer within the grid conductors 12. Insofar as the temperature of the grid conductors 12 cannot be maintained constant, dimensional growth and contractions of the grid conductors 12 are accommodated to by flexing of the support elements 16 notwithstanding the fact that the grid conductors are positively secured to the supporting structure at each end. Continuity of the fluid coolant circuit is maintained during such flexing of the support elements by the bellows 51 which expand or contract as necessary to accommodate to the movement. While enabling axial expansion and contraction of the grid conductors, the support elements 16 resist lateral displacements of significant extent such as might interfere with critical alignment of the grid conductors with those of other grids or other components of the system.

The foregoing description of a preferred embodiment of the invention has been presented for purposes of illustration and description. It is not intended to be exhaustive or to limit the invention to the precise form disclosed, and modification and variations are possible in the light of the above teaching. The described embodiments were chosen and described in order to best explain the principles of the invention and its practical application and thereby enable others skilled in the art to best utilize the invention in various embodiments and with various modifications as are suited to the particular uses contemplated. It is intended that the scope of the invention be defined by the claims appended hereto.

We claim:

1. In a fluid cooled electrical grid having a plurality of electrical conductors spaced apart to define a plurality of openings through the grid and having conductor support means for supporting said conductors while enabling axial extension and contraction thereof in response to temperature changes, the improvement comprising:

said conductors having internal flow passages which extend therewithin and wherein said grid includes convective cooling means for directing a flow of fluid coolant through said internal flow passages of said conductors.

2. An electrical grid as set forth in claim 1 wherein said support means secures said conductors in said grid while enabling individual extension and contraction of each of said conductors relative to the others thereof.

3. An electrical grid as defined in claim 2 wherein said support means enables independent longitudinal expansion and contraction of each of said conductors while being relatively resistant to movement of said conductors towards each other.

4. An electrical grid as defined in claim 1 further including a plurality of flexible conductor support elements to which said conductors are secured, individual ones of said support elements being disposed at each end of each of said conductors, wherein each of said support elements is flexible independently of the others thereof.

5. An electrical grid as defined in claim 4 wherein each of said support elements has a portion of reduced thickness relative to other portions thereof whereby flexing of said support elements occurs at least primarily at said portions of reduced thickness.

6. An electrical grid as set forth in claim 4 wherein each of said flexible support elements has a coolant passage communicated with said internal flow passage of the one of said conductors which is secured thereto and wherein said convective cooling means circulates said fluid coolant within said conductors through said coolant passages of said support elements.

7. An electrical grid as defined in claim 6 wherein each of said support elements has a recess causin the adjacent portion of the support element to be of reduced thickness relative to other portions thereof, further including a plurality of extendable and contractable fluid transmitting elements each being disposed in said recess of a separate one of said support elements and being positioned therein to form a portion of said coolant passage of the support element.

8. An electrical grid as defined in claim 7 wherein said extendable and contractable fluid transmitting elements are tubular bellows.

9. An electrical grid structure as set forth in claim 7 further including electrically conductive closure means for said recesses of said support elements.

10. An electrical grid as defined in claim 7 wherein said conductors are of equal length and wherein a first column of said support elements are disposed in parallel side by side relationship with each other along first ends of said conductors and a second column of said support elements are disposed in parallel side by side relationship with each other along the opposite ends of said conductors.

11. An electrical grid comprising:

a frame having an opening therethrough, first and second columns of flexible support elements extending from said frame, said first and second columns being disposed along opposite sides of said opening of said frame and each of said support elements having a coolant flow passage therein, a plurality of spaced apart parallel electrical conductors each having a first end portion secured to an individual one of said support elements of said first column thereof and having a second end portion secured to an individual one of said support elements of said second column thereof, each of said conductors having an internal flow passage communicated with said coolant passages of the ones of said support elements to which the conductor is secured, and convective cooling means for directing a flow of fluid coolant through said coolant passages of said support elements and said internal flow passages of said conductors.

12. An electrical grid as set forth in claim 11 wherein said conductors are linear and disposed in parallel relationship with each other and wherein said support elements are flexible in the direction of axial expansion and contraction of said conductors and are relatively resistant to flexing in transverse directions.

13. An electrical grid as set forth in claim 12 wherein said conductors lie in a plane spaced from the plane of said frame and parallel thereto and wherein said support elements are angled relative to said frame and said conductors to extend therebetween.

14. An electrical grid as set forth in claim 11 wherein each of said support elements is partially transected by a recess, further including a plurality of extensible and contractable fluid transmitting elements one being disposed in said recess of each of said support elements and forming a portion of said coolant passage thereof.

15. An electrical grid as set forth in claim 11 wherein a plurality of said support elements of said first column thereof and a like plurality of said support elements of said second column thereof are integral portions of a first conductor mounting member secured to said frame, and wherein the other support elements of said first and second columns thereof are integral portions of a second conductor mounting member secured to said frame.

16. An electrical grid as set forth in claim 15 wherein said conductors are linear and parallel and of equal length and form a rectangular planar grid structure and wherein substantially one half of said conductors are secured to said support elements of said first conductor mounting member and the others of said conductors are secured to said support elements of said second conductor mounting member, said first and second conductor mounting members having juxtaposed surfaces lying in a plane which is normal to said planar grid structure.

* * * * *